US007014065B2

(12) United States Patent
Jensen

(10) Patent No.: US 7,014,065 B2
(45) Date of Patent: Mar. 21, 2006

(54) DISPENSER FOR SERIES-CONNECTED TICKETS

(75) Inventor: Craig Jensen, Adel, IA (US)

(73) Assignee: Schafer Systems Inc., Adair, IA (US)

( * ) Notice: Subject to any disclaimer, the term of this patent is extended or adjusted under 35 U.S.C. 154(b) by 213 days.

(21) Appl. No.: 10/776,494

(22) Filed: Feb. 11, 2004

(65) Prior Publication Data

US 2005/0173447 A1 Aug. 11, 2005

(51) Int. Cl.
*A47F 1/04* (2006.01)

(52) U.S. Cl. ..... 221/310; 221/307; 221/255; 221/44

(58) Field of Classification Search ..... 221/44, 221/255, 276, 280, 303, 307, 310
See application file for complete search history.

(56) References Cited

U.S. PATENT DOCUMENTS 978,052 A 12/1910 Oehring
2,125,754 A * 8/1938 Steiner ..... 225/53
2,887,247 A 5/1959 Williams
4,239,164 A * 12/1980 Barnsbee et al. ..... 242/419.4
4,738,384 A 4/1988 Tigner
4,858,806 A * 8/1989 Schafer ..... 225/32
5,100,038 A 3/1992 Schafer
5,287,980 A * 2/1994 Saltz ..... 220/4.27
5,294,034 A * 3/1994 Svensson ..... 225/106
5,399,005 A 3/1995 Schafer
5,606,883 A * 3/1997 Svec ..... 70/370
5,873,481 A * 2/1999 Gruhn et al. ..... 220/210

* cited by examiner

*Primary Examiner*—Khoi H. Tran
(74) *Attorney, Agent, or Firm*—G. Brian Pingel; Camille L. Urban; Adam W. Jones

(57) ABSTRACT

An improved dispenser for displaying and dispensing lottery tickets utilizes a dispensing slot with tension arms to provide tension to tickets of varying thicknesses. The dispensing slot is cut into a door at an end of a box-like structure, which holds the tickets. Tension arms extend from the bottom of the slot into notches at the top of the slot such that the slot is narrower than the thickness of the tickets. Because the tension arms are also flexible, tickets of varying thickness can pass through the slot without becoming stuck.

15 Claims, 7 Drawing Sheets

DISPENSER FOR SERIES-CONNECTED TICKETS

BACKGROUND OF THE INVENTION

1. Field of the Invention

The present invention relates in general to a structure for dispensing tickets. More particularly, this invention relates to a dispensing slot with tension arms for dispensing tickets.

2. Description of the Prior Art

It is known in the art to use a box-like structure with a dispensing slot for dispensing tickets. Such structures have included features for preventing unauthorized access to tickets and for stacking ticket dispensers. A problem with previous devices has been the dispensing of tickets of various thicknesses. The tension on the ticket must be great enough to prevent the ticket from falling out of the dispenser, but not so great that the ticket becomes stuck in the dispensing slot.

Ticket dispensers with tension exit means are shown in U.S. Pat. Nos. 978,052, 2,887,247, 4,73.8,384, and 5,100,038. While the devices disclosed in these patents utilize a tension dispensing means, all of them are more complex than the present invention, requiring springs and/or manual adjustments in order to properly function.

U.S. Pat. No. 5,399,005 discloses a stackable box-like structure with rollers mounted such that the rollers create a fulcrum effect on tickets to allow for the proper dispensing of tickets of various thicknesses. The rollers suffer from wear as tickets are dispensed, and require servicing to restore the device to proper function.

The present invention provides a simplified means for continual proper tension on the tickets as they are drawn through the dispensing slot, without need for springs, moving parts, manual adjustments, or servicing.

It is therefore an object of the invention to provide an improved ticket dispensing slot to provide tension on the tickets to facilitate proper dispensing.

It is also an object of the invention to provide a ticket dispensing slot with a simplified design allowing maintenance free operation.

SUMMARY OF THE INVENTION

The present invention is a ticket dispensing structure with an improved dispensing slot for lottery-style tickets. The structure includes an exit means with resilient tension arms extending upwards slightly into notches in the upper portion of the dispensing slot. The tension arms push the tickets against the upper portion of the dispensing slot, preventing the tickets from falling through the slot. Because the tension arms are flexible, tickets of varying thicknesses experience tension without becoming stuck in the slot.

One of the advantages of the present invention is that it is of a simple design that can be formed into one piece, does not wear like rollers, requires no moving parts like springs or rollers, costs less to produce and maintain, and lasts longer before requiring replacement.

Another advantage of the present invention is that the dispensing slot can accommodate tickets of various thicknesses.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter, which the inventor does regard as his invention, is particularly pointed out and distinctly claimed in the claims at the conclusion of this specification.

BRIEF DESCRIPTION OF THE DRAWINGS

FIG. 6(*a*) is shown similar to FIG. 6, but with the door open.

DETAILED DESCRIPTION OF THE PREFERRED EMBODIMENT

Figure 1:
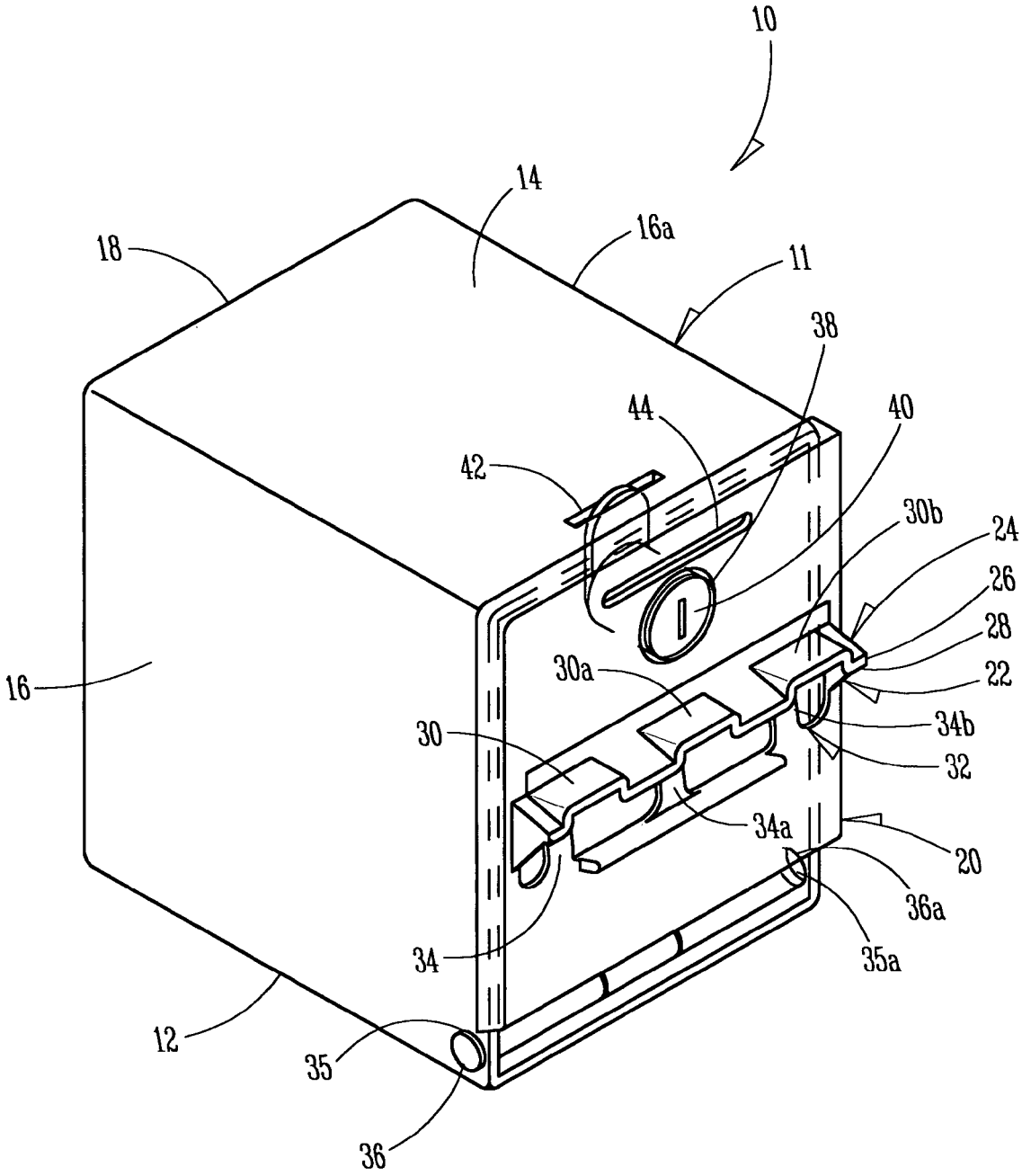
FIG. 1 is a rear perspective view of the preferred embodiment of an improved ticket dispenser.
Figure 5:
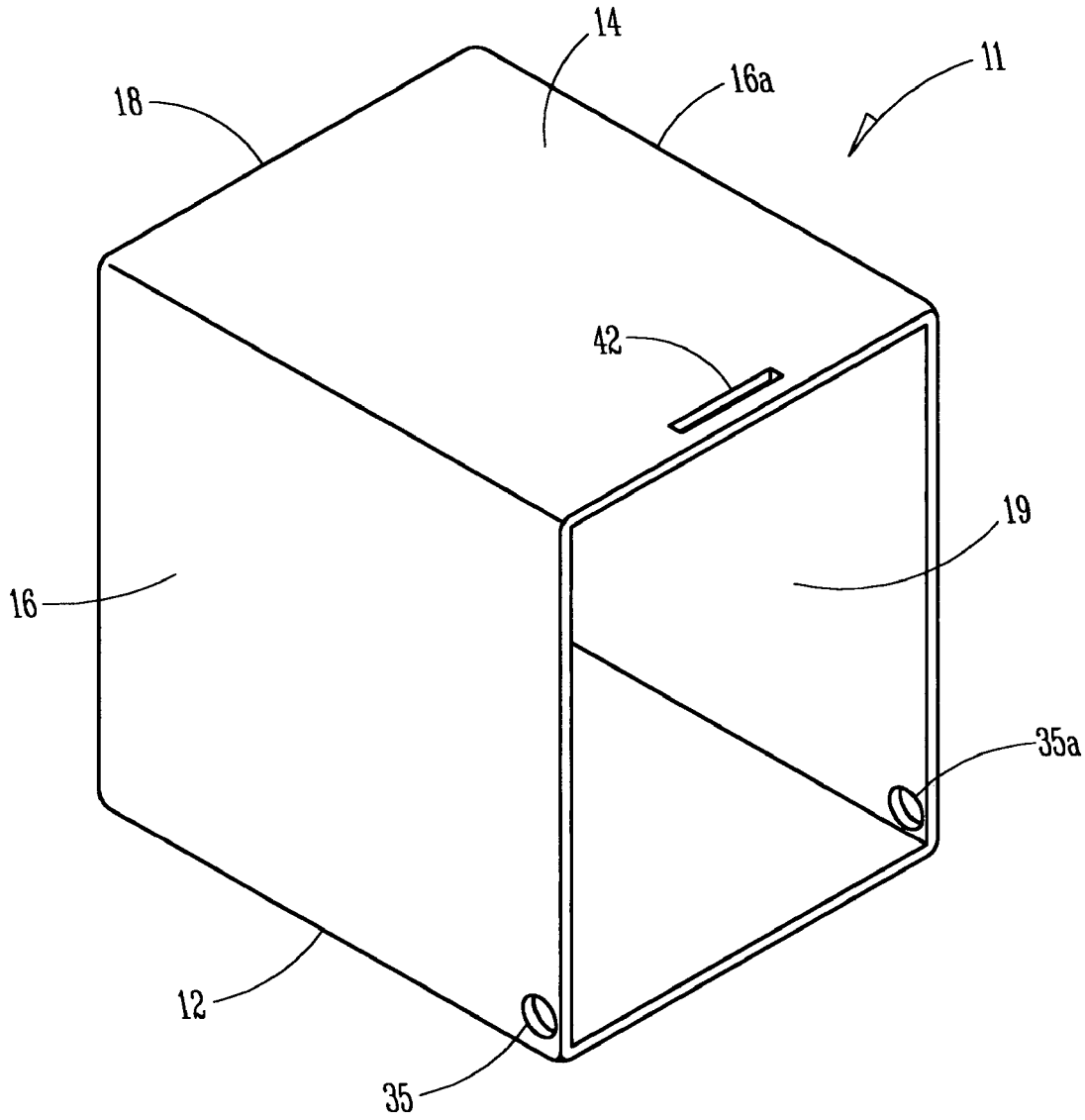
FIG. 5 is a rear perspective view of the preferred embodiment of an improved ticket dispenser without the door.
Figure 7:
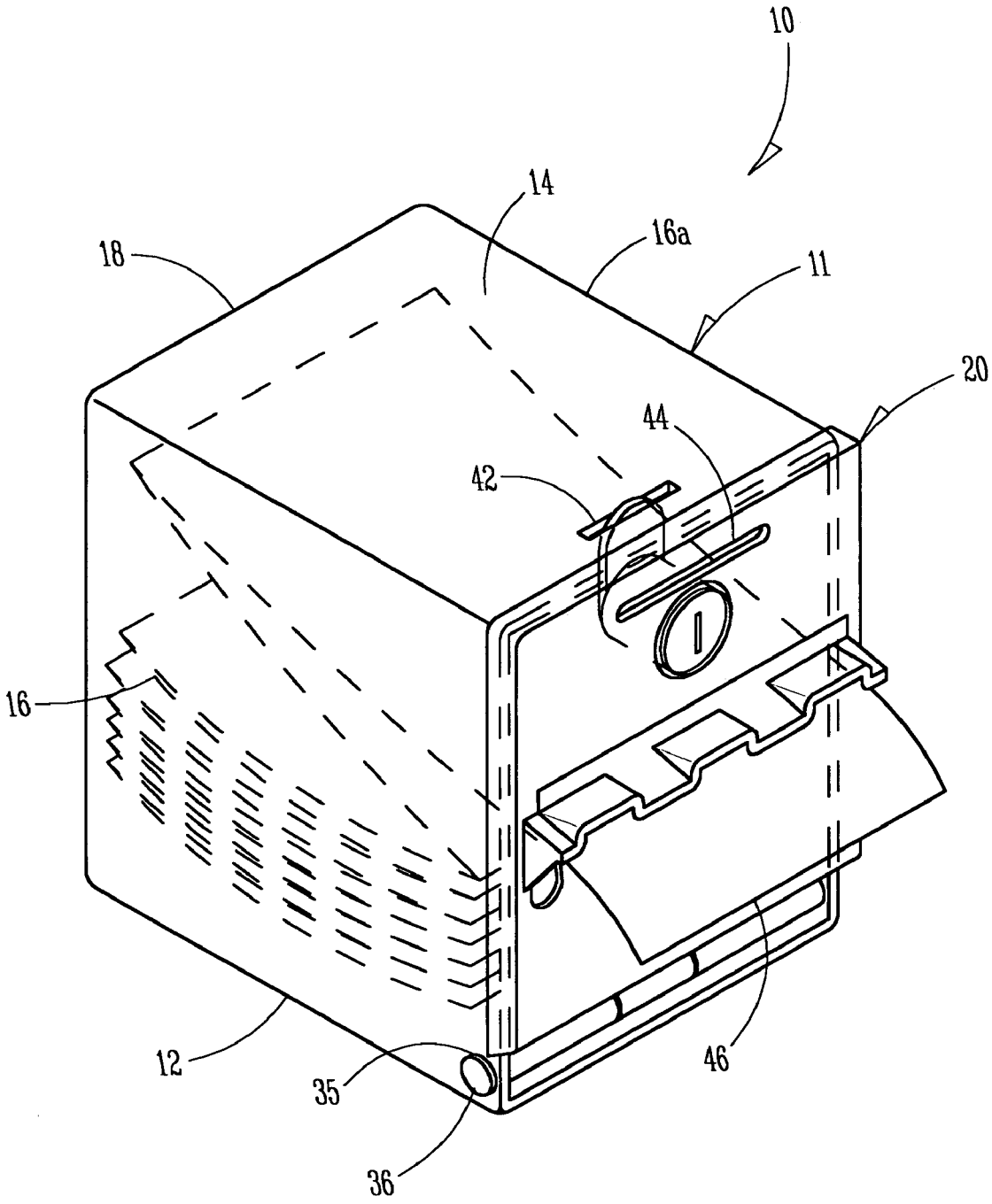
FIG. 7 is a rear perspective view of the preferred embodiment of an improved ticket dispenser showing tickets inside the dispenser and tickets passing through the ticket dispensing slot in the door.

With reference to the drawings, an improved ticket dispenser that is the preferred embodiment of the present invention is disclosed at 10 in FIG. 1. The invention is defined by a box-like structure 11 with a floor 12, a roof 14, sidewalls 16 and 16(*a*), a front wall 18, and a rear opening disclosed at 19 in FIG. 5. Pivotally attached near the rear opening 19 of box-like structure 11 is a door disclosed at 20 in FIG. 1. A plurality of tickets, disclosed at 46 in FIG. 7, may be stored in the box-like structure 11. In the preferred embodiment, the entire structure is formed of transparent polycarbonate to allow viewing of the tickets inside the dispenser 10.

Figure 2:
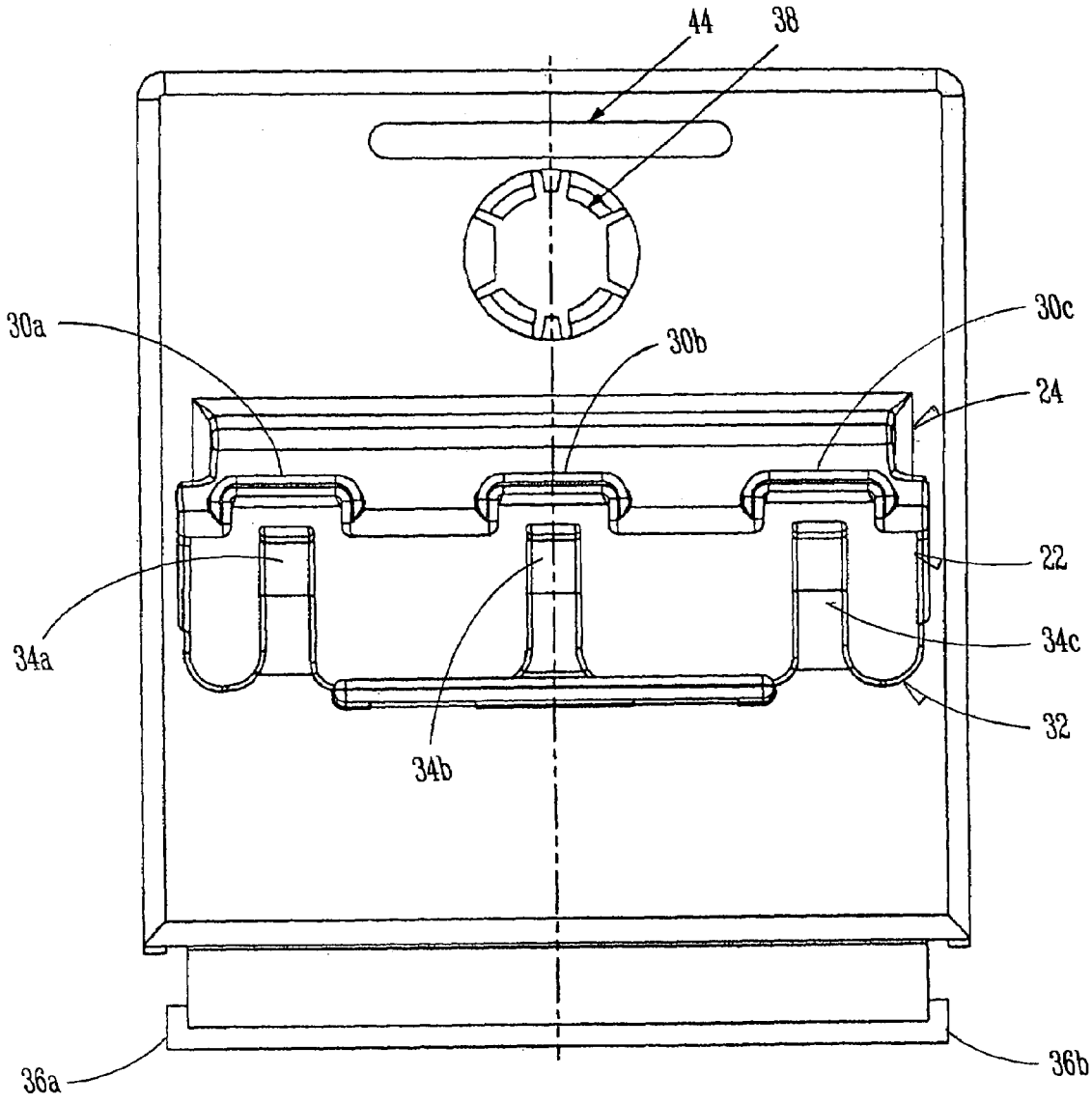
FIG. 2 is a front view in elevation of the preferred embodiment of a door with a transverse ticket dispensing slot which is part of the improved ticket dispenser of FIG. 1.
Figure 4:
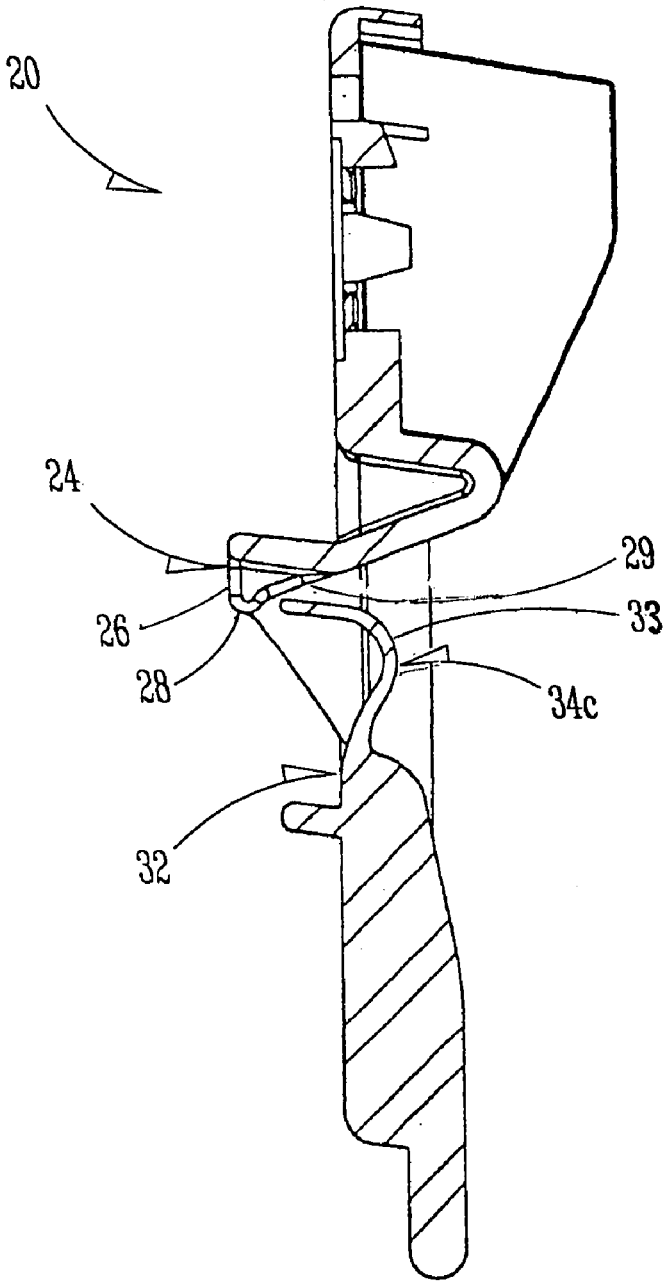
FIG. 4 is a side cross-sectional view in elevation of the door with a transverse ticket dispensing slot of FIG. 2.

Referring now to FIG. 2, a transverse ticket dispensing slot 22 is formed in the door 20. The dispensing slot 22 is formed by an upper ledge portion 24 with an outer edge 26 where tickets 46 exit the dispensing slot 22. In the upper ledge portion 24 is a notch 30. There are three such notches 30, 30(*a*), and 30(*b*) in the upper ledge portion 24 of the preferred embodiment. As best shown in FIG. 4, the preferred embodiment also has a lip 28 at the outer edge 26 of the upper ledge portion 24.

Referring back to FIG. 2, extending from a lower portion 32 of the dispensing slot 22 is a resilient tension arm 34. The tension arm 34 extends into the notch 30. The preferred embodiment includes second and third tension arms 34(*a*) and 34(*b*), which extend into notches 30(*a*) and 30(*b*), respectively.

Figure 6:
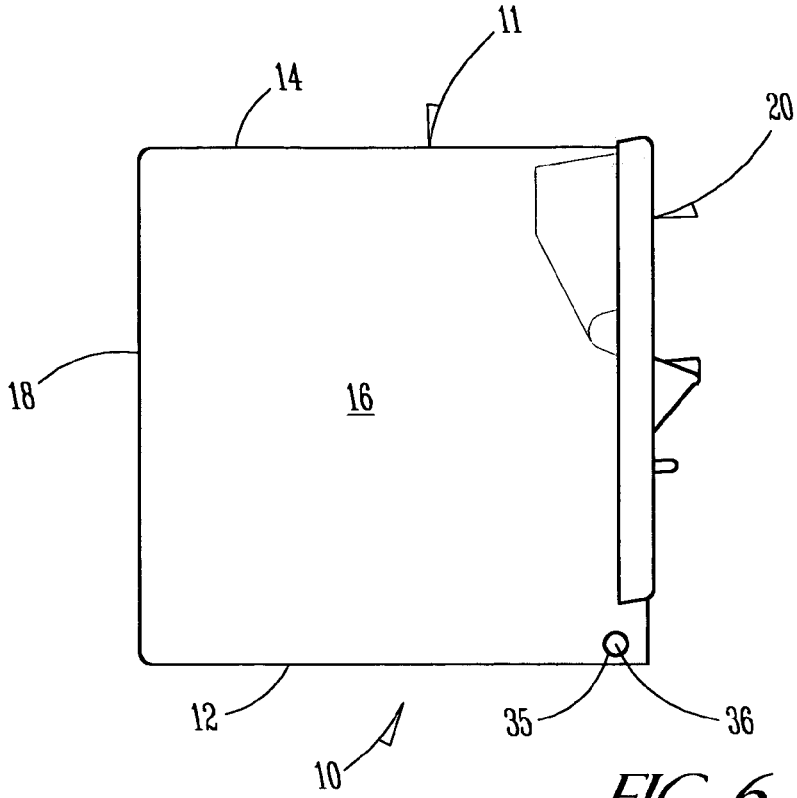
FIG. 6 is a side view in elevation of the preferred embodiment of an improved ticket dispenser with the door closed.
Figure 6A:
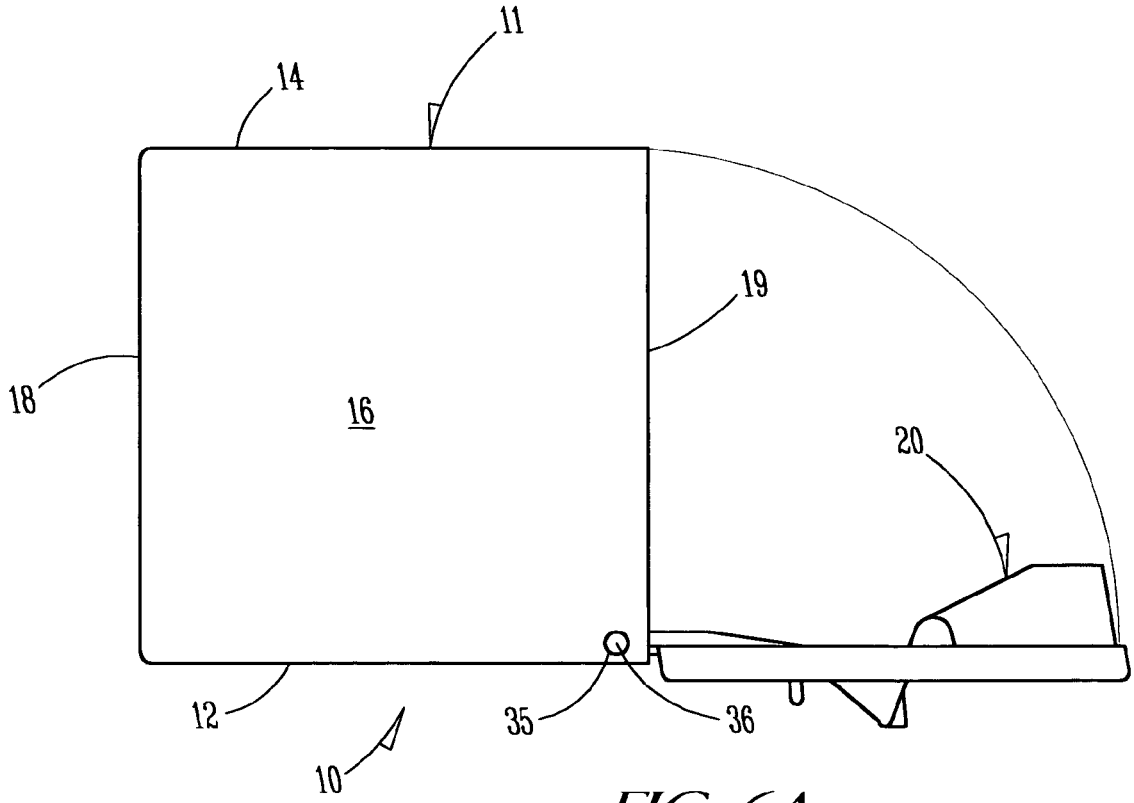

Referring back to FIG. 1, the door 20 also has pivot attachments 36 and 36(*a*) extending horizontally from the bottom corners of the door 20 which fit into door attachment apertures 35 and 35(*a*) in sidewalls 16 and 16(*a*), respectively, near the floor 12 and near the rear opening 19. An aperture 38 for a security lock 40 is located in the door 20 above the dispensing slot 22. A slit 42, as seen in FIG. 1, in the roof 14 near the rear opening 19 of the box-like structure 11 engages the security lock 40 to lock the door 20 to cover the rear opening 19 of the box-like structure 11. A security door slot 44 is in the door 20 above the aperture 38 for the lock 40. As seen in FIG. 6, the door 20 can be in an open or closed position to load the box-like structure 11 or dispense tickets 46, respectively. The door 20 is semipermanently attached when the lock 40 engages the slit 42. The security door slot 44 may be engaged by a security door (not shown) that may cover the dispensing slot 22 to prevent unauthorized entry into the dispenser 10.

Figure 3:
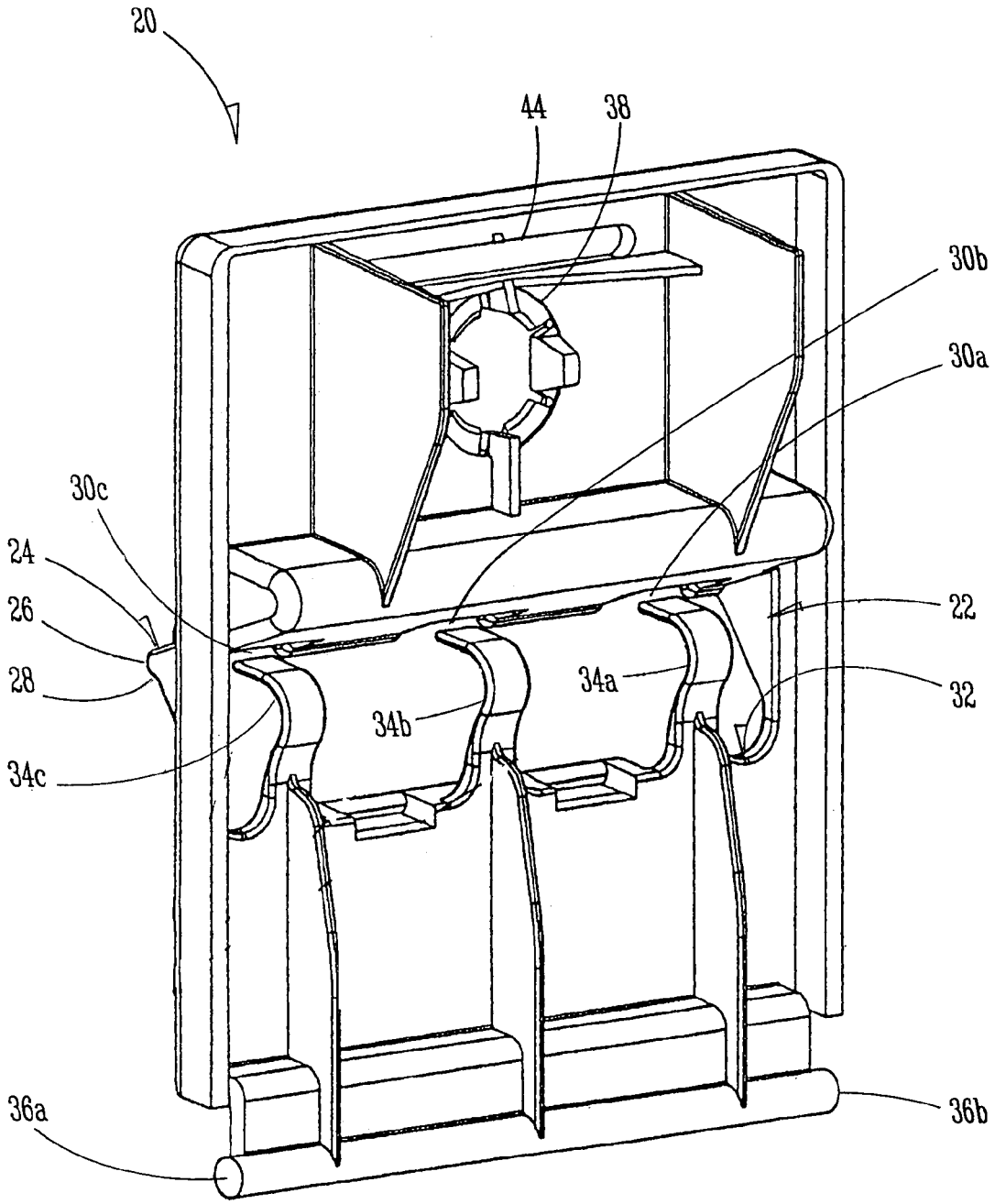
FIG. 3 is a rear perspective view in elevation of the door with a transverse ticket dispensing slot of FIG. 2.

As best seen in FIG. 3 and FIG. 4, the tension arm 34 is curved, with a convex portion 33 of the tension arm 34 facing away from the outer edge 26 of the dispensing slot 22 and facing towards the front wall 18 of the box-like structure 11 when the door 20 is in a closed position. FIG. 4 shows that the tension arm 34 extends so closely to the lower surface 29 of the upper edge portion 24, the dispensing slot 22 is narrower than the thickness of the tickets 46. Also shown in FIG. 4, in the preferred embodiment the lower surface 29 of the upper ledge portion 24 slopes downwardly to guide the tickets through the dispensing slot 22. Because the tension arm 34 is flexible, tickets 46 passing through the dispensing slot 22 will not become stuck and the dispensing slot 22 accommodates tickets of varying thicknesses. In the preferred embodiment, the door 20 is one piece injected molded polycarbonate. The polycarbonate in the preferred embodiment is clear, allowing the tickets 46 to be viewed.

The present invention has been described in an illustrative manner. It is to be understood that the terminology, which has been used, is intended to be in the nature of words of description rather than of limitation. Many modifications and variations of the present invention are possible in light of the above teachings. For example, the width of dispensing slot 22 and the number of notches 30 and tension arms 34 may be varied depending on the dimensions of the tension arms 34, notches 30, and the tickets 46 to be dispensed. Therefore, within the scope of the appended claims, the present invention may be practiced otherwise than as specifically described.

What is claimed is:

1. An improved dispenser for series-connected tickets comprising:

a. a box-like structure having a floor, a roof, a pair of side walls, a front wall, and a rear opening;

b. a door associated with said box-like structure to cover the rear opening of said box-like structure when in a closed position; and c. a transverse ticket dispensing slot in said door whereby a plurality of tickets may be dispensed from said box-like structure including:

i. an upper ledge portion with a lower and an outer edge where the tickets exit from the dispenser;

ii. at least one notch in the outer edge of said upper ledge portion;

iii. a lower portion spaced apart from said upper ledge portion to form said transverse ticket dispensing slot; and iv. at least one resilient tension arm extending from the lower portion toward the upper ledge portion and into the at least one notch such that the outer edge of the upper ledge portion is below the upper most surface of said resilient tension arm for providing sufficient tension on the tickets as said tickets are dispensed through said dispensing slot.

2. An improved dispenser as recited in claim 1, wherein said lower surface of the upper ledge portion slopes downwardly.

3. An improved dispenser as recited in claim 1, wherein said door is pivotally attached to said box-like structure by a pivotal attachment means comprising a. two pivot attachments extending horizontally from said door;

b. attachment apertures in the side-walls of said box-like structure near the floor and near the rear opening for engaging said two pivot attachments;

c. a lock in said door opposite said two pivot attachments; and d. a slit in the roof of the box-like structure for engaging the said lock.

4. An improved dispenser as recited in claim 1, wherein said outer edge comprises a lip where tickets exit the improved dispenser.

5. An improved dispenser as recited in claim 1, wherein said upper ledge portion contains a plurality of said notches and a corresponding plurality of resilient tension arms extending from said lower portion.

6. An improved dispenser as recited in claim 4, wherein said upper ledge portion contains three of said notches and three of said resilient tension arms extending from said lower portion.

7. An improved dispenser as recited in claim 1, wherein said at least one resilient tension arm is formed of a flexible material such that the tension arm temporarily deflects when one of said plurality of tickets presses against the resilient tension arm as it is dispensed through the transverse dispensing slot.

8. An improved dispenser as recited in claim 1, wherein said tension arm comprises a convex portion such that the ticket is dispensed over the convex portion of the resilient tension arm.

9. An improved dispenser as recited in claim 1, wherein the door comprises an aperture for a lock.

10. An improved dispenser as recited in claim 1, wherein the door comprises means for securing the dispensing slot from unauthorized access into the dispenser.

11. An improved dispenser as recited in claim 10, wherein the means for securing the dispensing slot includes a security door slot to engage a security door to cover the dispensing slot.

12. An improved dispenser as recited in claim 1, wherein the door is formed of one piece injected molded plastic.

13. An improved dispenser as recited in claim 12, wherein the plastic is polycarbonate.

14. An improved dispenser as recited in claim 1, wherein the box-like structure and the door are formed of a transparent material to allow viewing of the tickets.

15. An improved dispenser as recited in claim 14, wherein the transparent material is polycarbonate.

* * * * *